US008745937B1

(12) United States Patent
Mang, Sr. et al.

(10) Patent No.: US 8,745,937 B1
(45) Date of Patent: Jun. 10, 2014

(54) REFACED STAIRCASE

(71) Applicant: Ideal Wood Products, Inc., Little Falls, NY (US)

(72) Inventors: Bruce R. Mang, Sr., Richfield Springs, NY (US); Steven H. Mott, Gettysburg, PA (US); Douglas P. Plourde, Waterville, NY (US); Norman J. Plourde, Valatie, NY (US)

(73) Assignee: Ideal Wood Products, Inc., Little Falls, NY (US)

( * ) Notice: Subject to any disclaimer, the term of this patent is extended or adjusted under 35 U.S.C. 154(b) by 0 days.

(21) Appl. No.: 13/972,323

(22) Filed: Aug. 21, 2013

Related U.S. Application Data

(62) Division of application No. 12/850,660, filed on Aug. 5, 2010, now Pat. No. 8,516,771.

(60) Provisional application No. 61/231,774, filed on Aug. 6, 2009.

(51) Int. Cl.
*E04F 11/00* (2006.01)

(52) U.S. Cl.
USPC ..... 52/188; 52/182; 52/183; 52/741.2

(58) Field of Classification Search
USPC ..... 52/182, 183, 188, 190, 191, 184, 741.2
See application file for complete search history.

(56) References Cited

U.S. PATENT DOCUMENTS

| | | | |
|---|---|---|---|
| 569,464 | A | 10/1896 | Moore |
| 3,393,481 | A | 7/1968 | Meuret |
| 4,783,939 | A | 11/1988 | Bergmann et al. |
| 6,115,975 | A | 9/2000 | Abdollahi |
| 6,397,529 | B1 | 6/2002 | Grenier |
| 6,665,987 | B2 | 12/2003 | Eve et al. |
| 6,960,273 | B2 | 11/2005 | Jung |
| 7,464,505 | B2 | 12/2008 | Grenier |
| 8,033,063 | B2 | 10/2011 | Won |
| 8,141,321 | B2 | 3/2012 | Young |
| 2007/0028534 | A1 | 2/2007 | Defehr et al. |
| 2008/0271390 | A1 | 11/2008 | Lopez |

*Primary Examiner* — Chi Q Nguyen
(74) *Attorney, Agent, or Firm* — Hooker & Habib, P.C.

(57) ABSTRACT

A refaced staircase having original treads and original risers with replacement treads and replacement risers is disclosed. A replacement riser extends down from each original tread, and a replacement tread is placed over the original tread and overhangs the replacement riser. The replacement tread preferably includes a scotia facing the original tread that hides the seam between the original tread and the replacement riser.

20 Claims, 1 Drawing Sheet

REFACED STAIRCASE

FIELD OF THE DISCLOSURE

The disclosure relates generally to the field of staircases, and in particular, to a refaced staircase.

BACKGROUND OF THE DISCLOSURE

A conventional residential staircase includes horizontal step treads and vertical risers extending vertically between the treads.

Renovating an old residential staircase is conventionally done in one of two ways:

(1) the old staircase is removed, and a new staircase constructed in place, or (2) new treads are placed over the existing treads.

Option (1) is expensive, and requires skilled labor familiar with staircase construction.

Option (2) often results in a staircase that does not comply with building codes. The new tread alters the rise/run or the tread depth of the staircase such that the modified staircase is no longer in code compliance.

Most staircases are built with stairs in which the tread overhangs the riser at the front of the tread. The overhang is typically between three-quarters of an inch and one and one-half inches in residential construction. Often the overhanging portion of the tread is cut off when installing new tread over the existing tread, adding to labor cost and requiring cleanup of sawdust and cuttings.

Known methods of refacing a residential staircase have other disadvantages.

Jung, U.S. Pat. No. 6,960,272 discloses a method wherein a replacement tread is placed on and overhangs the old tread. A replacement riser fits in a bottom groove formed in the overhanging portion of the replacement tread and then bends back to be supported against the old riser and against the bottom of the next lower old tread. The construction is relatively expensive and so is not practical for refacing. Fasteners installed from the upper side of the replacement tread are visible.

Abdollahi, U.S. Pat. No. 6,115,975 discloses a stair system that might be adaptable to refacing an existing staircase. The vertically spaced ends of a replacement riser is captured in grooves or dadoes formed in the upper replacement tread and a lower back molding supported on the lower replacement tread. The construction is relatively complicated and so is not practical for refacing. The back molding is visible, impairing the smooth transition between the lower replacement tread and the replacement riser.

Lopez, US Patent Application Publication 20080271390 discloses an apparatus for refacing an existing staircase. The apparatus includes a replacement tread, a nosing on the front end of the replacement tread, and a replacement riser attached to the nosing and extending from the bottom side of the replacement tread near the front end of the tread. The replacement riser is spaced a fixed distance from the front end of the replacement tread, which may change the tread depth of the stairs after refacing. The change in tread depth may cause the refaced stairs to go out of code. Having the replacement tread and replacement riser formed as an integral piece also makes the apparatus bulky to transport and handle. Installation on uneven floors can be difficult.

Defahr et al., US Patent Application Publication 20070028534 discloses a stair system that might be adaptable to refacing an existing staircase. A replacement tread plate has a nosing member faces and covers the front edge of an existing tread. A replacement riser is attached to and bears directly against the original riser below the original tread. The replacement riser extends between the top of the next lower replacement tread and the bottom of the existing tread. Defahr et al. however, does not recognize that placing the replacement riser against the original riser affects the resulting rise/run of the refaced staircase.

Thus there is a need for an improved refaced staircase that enables the disadvantages of the prior art staircases to be avoided.

BRIEF SUMMARY OF THE DISCLOSURE

Disclosed is an improved method of renovating or refacing a refaced staircase that results thereby. The method does not require removing the old staircase, does not require skilled labor and could even be successfully carried out by "do-it-yourselfers", and keeps the staircase in compliance with building codes. The component parts are easy to transport, handle, and install.

The method of refacing the staircase includes the steps of:

(a) installing a replacement tread over the existing tread of the staircase;

(b) installing a replacement riser against the existing riser extending above the existing tread.

The replacement tread preferably overhangs the existing, original tread the same distance that the original tread overhangs the original riser.

The replacement riser extends from the replacement tread and preferably has the same thickness (typically three-quarters of an inch) as the tread overhang at the top of the replacement riser. The installed replacement riser is then flush with the overhanging tread. Repeat for each step, preferably working from the bottom of the stairs and up the stairs to the upper landing floor. Finish by installing a replacement tread on the upper landing floor.

Preferably the replacement treads have a thickness of ¾ inch. Many staircase renovations are undertaken because new hardwood flooring is installed on the bottom landing floor. Hardwood flooring is conventionally three-quarters of an inch thick and the new flooring raises the elevation of the lower landing floor by the thickness of the flooring. Using a tread thickness the same thickness as the hardwood floor keeps the rise/run of the refaced staircase the same as the original.

If the staircase is refaced without changing the lower landing floor, the thickness of the replacement tread at the first step next to the lower landing floor and at the upper landing floor is preferably relatively thin, preferably about three-eighths of an inch. Using a relatively thin tread at these two end locations of the staircase will keep the rise/run of the staircase in compliance with building codes.

If the tread overhang of the original staircase is greater than three-quarters of an inch, the replacement riser can be shimmed against the original riser to be flush with the tread overhang. This maintains the same tread depth as the original tread.

Preferably the replacement tread has a nosing and a scotia that overhangs the original tread and extends downwardly beyond the upper end of the adjacent replacement riser. This covers the joint between the replacement riser and the overhanging original tread for added support of the riser and provides a desirable ornamental effect. Preferably the replacement tread and the nosing scotia are preformed as an integral piece and are prefinished for ease of handling and installation.

The replacement treads and risers are preferably cut to appropriate lengths equal to the stair width of the staircase prior to beginning installation. These cuts can be made outdoors to keep the house interior clean.

The disclosed stair refacing has a number of advantages as recited above. It can also be useful for new construction. Often staircases are manufactured off-site and then installed while the house is partially complete. Construction workers and equipment going up and down the staircase will damage the staircase. Instead, the staircase manufacture can manufacture the staircase frame off-site and workers and equipment can then use the staircase frame. A refaced staircase can be formed over the tread and risers of a staircase frame using finished hardwood risers and treads to complete a finished staircase after home construction is essentially complete.

Other objects and features will become evident as the description proceeds, especially when taken in conjunction with the accompanying drawing sheets.

DESCRIPTION OF THE PREFERRED EMBODIMENT

Figures 1, 2:
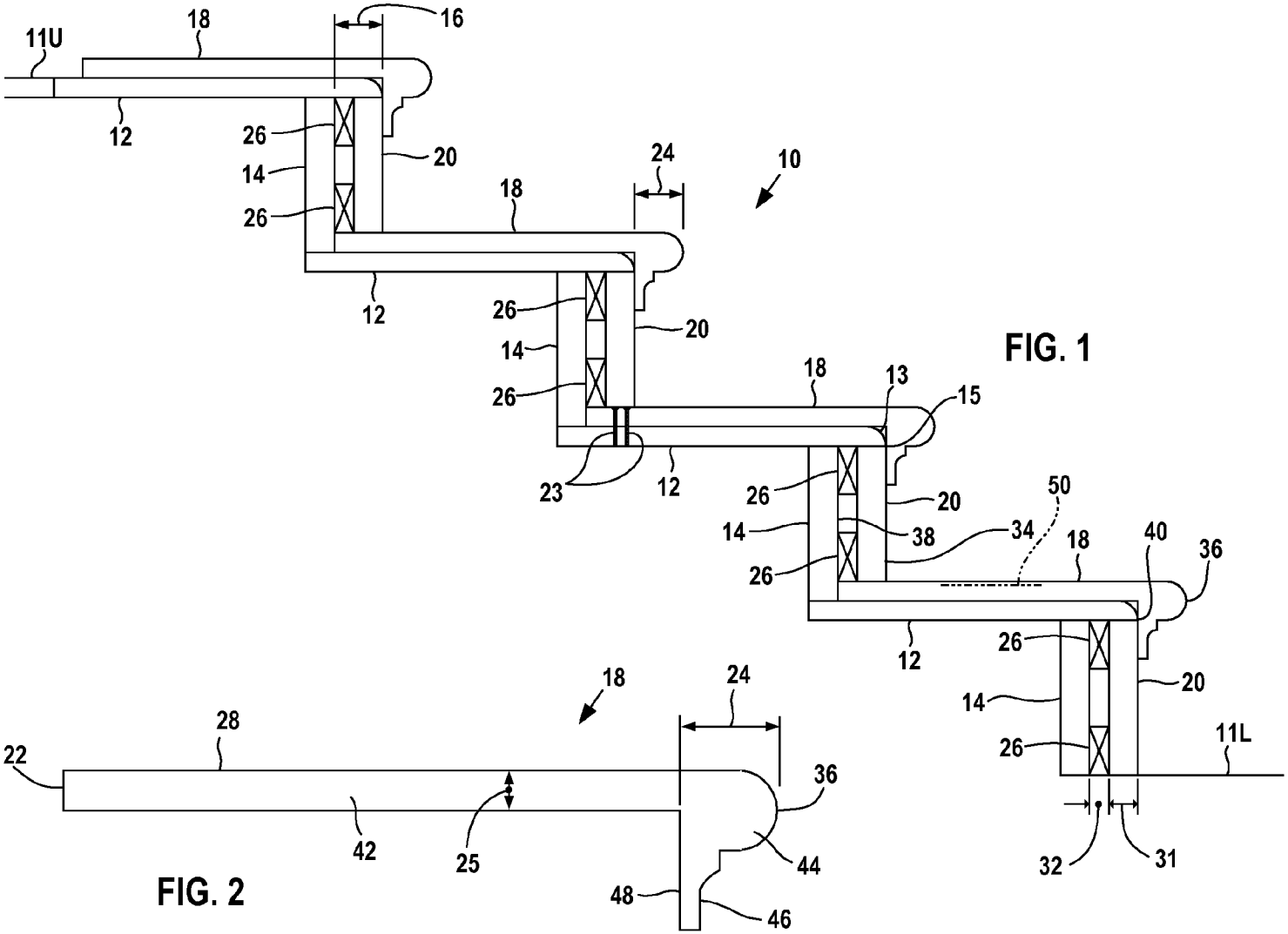
FIG. 1 is a side view of a refaced staircase.
FIG. 2 is a side view of a replacement tread used in refacing the staircase shown in FIG. 1.

FIG. 1 illustrates a refaced residential staircase 10. Any previously applied carpeting or additional flooring materials were removed from the staircase prior to refacing. The staircase extends between a lower landing 11L and an upper landing 11U, and includes a number of original treads 12 and original risers 14. In the illustrated embodiment each tread 12 overhangs a riser 14 by a distance 16 of one inch. Each tread 12 further includes a bullnose 13 located on a front edge or front end 15 of the tread 12.

The staircase 10 has been refaced using a number of like replacement treads 18 and like replacement risers 20. FIG. 2 is an enlarged view of a single replacement tread 18.

Each replacement tread 18 is placed on and supported on a respective original tread 12. The back end 22 of the replacement tread 18 butts against the original riser 14 with the replacement tread 18 overhanging the original tread 12 by a distance 24 of one inch, that is, the replacement tread 18 overhangs the original tread 12 by the same distance the original tread 12 overhangs the original riser 14. Industrial adhesive is preferably used between the replacement tread 22 and the original tread 12. The back edge of the replacement tread 18 can be nailed or otherwise through-fastened to the original tread by fasteners 23. Note that the nails or fasteners 23 being placed sufficiently towards the back edge of the replacement tread 18 are hidden by the replacement riser 20 and will not be visible when installation is completed.

The replacement treads 18 preferably have equal thickness dimensions 25 to maintain the same rise between steps, but the tread thicknesses of the uppermost and lowermost replacement treads can vary within code allowances to accommodate the transition from the landing to the stairs. For example, the lowermost replacement tread 18 may be relatively less thick to reduce the rise between it and the original lower landing 11L. FIG. 1 illustrates with the phantom line 50 the top surface of a thinner tread 18 that may be used to transition from the landing 11L to the stairs.

The illustrated replacement risers 20 are each attached to a respective original riser 14 but are spaced from the riser 14 by respective sets of shims 26 placed between the original and replacement risers 14, 20. The illustrated embodiment employs a pair of shims 26 to space a replacement riser 20 away from an original riser 14: a lower shim 26 against the lower replacement tread plate 18 and an upper shim 26 against the upper original tread plate 12. Each replacement riser 20 extends vertically from the upper surface 28 of the adjacent lower replacement tread (except that the lowest riser 14 extends vertically from the lower level 11L) to the lower surface 30 of the adjacent upper replacement tread 20.

In the illustrated embodiment the replacement risers 20 each has a thickness dimension 31 of about three-quarters of an inch, that is, the thickness of the replacement risers 20 is less than the overhang distance 24. The shims 26 each have a respective thickness dimension 32 of one-quarter inch, equal to the difference between the overhang distance 24 and the riser thickness 30. The shims 26 locate the outer surface 34 of the replacement riser 20 the same distance from the front end 36 of an adjacent lower tread 18 as the outer surface 38 of the adjacent original riser 14 is from the front end 40 of an adjacent lower original tread 12. The resulting tread depth (distance from the front end of the tread to the back riser) of the replacement tread 18 is the same as the tread depth of the original tread 12 before refacing.

FIG. 2 illustrates a preferred embodiment of the replacement tread 18. The replacement tread 18 includes a flat, horizontal tread plate 42, a decorative nosing 44, and a scotia 46. The scotia 46 has a vertical inner exposed surface or face that is perpendicular to the tread plate 42 and is spaced inwardly from the front end of the tread 18 the overhang distance 24. Upon installation, the scotia 46 is located immediately next to the adjacent lower replacement riser 20 and partially overlays the lower replacement riser 20 to hide the seam between the tread 18 and the lower replacement riser 20.

The replacement treads 18 are preferably manufactured to be a one-piece, pre-finished member to save time at the construction site.

The preferred method of refacing the original staircase 10 in which the thickness of the replacement risers is less than the original tread overhang is as follows:

(1) Install the first set of shims against the lower-most original riser; preferably a lower shim is braced against the lower landing and an upper shim is braced against the lower surface of the lower-most original tread, the shims sized to locate a replacement riser flush with the front of the lower-most original tread;

(2) Install the lowermost replacement riser with its cut edge (if Step 1 requires cutting the replacement riser) up adjacent the lower landing and the factory edge facing the lowermost original tread;

(3) Install the lowermost replacement tread first, using full coverage construction adhesive between the replacement tread and the original tread;

(4) Secure the lowermost replacement tread by nailing or fastening the back edge of the replacement tread to the original tread, preferably locating the nails or fasteners to be hidden by the replacement riser so as not to be visible when installation is completed);

(5) Install the next set of shims; preferably a lower shim is braced against the upper surface of the replacement tread and an upper shim is braced against the lower surface of the adjacent upper original tread (but a different shimming arrangement can be used depending on the relative height and thickness of the replacement risers);

(6) Install the next replacement riser with its cut edge (if Step 1 requires cutting the replacement riser) up adjacent the lower surface of the adjacent upper original tread and the factory edge against the replacement tread);

(7) Continue up the stairs, refacing each next upper original tread and original riser) as described in steps (4)-(6); and (8) Trim the topmost replacement tread if necessary to match up with carpeting, flooring, or the like installed on the upper landing.

In alternative embodiments of the method the shims can be attached first to the replacement risers so that the steps of installing the shims against the original riser and installing the replacement riser against the shims are performed substantially simultaneously.

It is understood that the one or more embodiments disclosed herein are capable of modification, and we therefore do not wish to be limited to the precise details set forth, but desire to avail ourselves of such changes and alterations as fall within the purview of the following claims.

The invention claimed is:

1. A refaced staircase comprising:

an original staircase, a replacement tread, and a separate replacement riser;

the original staircase comprising an original tread and an original riser extending downwardly away from the original tread;

the original tread prior to refacing of the original staircase comprising an unsupported front end portion overhanging the original riser and a top surface being configured and disposed to contact and support a user standing on the original tread while using the original staircase prior to refacing, the front end portion extending from the original riser to a front end of the original tread;

the original riser prior to refacing of the original staircase comprising an exposed front surface nearest to the front end of the original tread and facing towards the front end of the original tread;

the replacement tread being placed on top of the original tread, the replacement tread comprising an exposed upper surface being configured and disposed to contact and support a user standing on the replacement tread while using the refaced staircase;

the replacement riser being disposed adjacent to the original riser and being spaced away from the front surface of the original riser by one or more shims disposed between the front face of the original riser and the replacement riser; and each of the one or more shims abutting the replacement riser.

2. The refaced staircase of claim 1 wherein the original tread comprises an overhanging portion that overhangs the original riser, the overhanging portion having a front edge spaced from the original riser, and the replacement riser is beneath the overhanging portion of the original tread and does not extend beyond the front edge of the original tread.

3. The refaced staircase of claim 2 wherein the replacement riser is flush with the front edge of the original tread.

4. The refaced staircase of claim 2 wherein the replacement tread comprises an overhanging portion that overhangs the original tread and a scotia extending downwardly from the overhanging portion, the scotia extending downwardly beyond the original tread.

5. The refaced staircase of claim 4 wherein the scotia has a surface facing the original riser, the replacement riser immediately adjacent the scotia surface.

6. The refaced staircase of claim 1 wherein the original tread has a tread depth and the replacement tread has a tread depth equal to the tread depth of the original tread.

7. The refaced staircase of claim 1 wherein the rise/run ratio defined by the replacement riser and the replacement tread is the same as the rise/run ratio defined by the original riser and the original thread.

8. The refaced staircase of claim 1 wherein the replacement riser extends downwardly to a second replacement tread and covers a portion of the second replacement tread, fasteners extending through the portion of the second replacement tread.

9. The refaced staircase of claim 1 wherein the original riser is one of a plurality of original risers, and the replacement riser is one of a plurality of replacement risers, each replacement riser spaced from its associated original riser by a respective set of one or more shims.

10. The refaced staircase of claim 9 wherein the staircase extends between an upper landing and a lower landing, a first replacement tread of the plurality of treads is adjacent to one of the upper landing and the second landing, and a second replacement tread of the plurality of treads is adjacent the first replacement tread, each of the first and second replacement treads having upper and lower surfaces separated by the thickness of the tread, wherein the thickness of the first replacement tread is different than the thickness of the second replacement tread.

11. A refaced staircase comprising:

an original staircase, a one-piece replacement tread, and a separate replacement riser;

the original staircase comprising an original tread adjacent to an original riser, the original riser extending downwardly away from the original tread;

the original tread prior to refacing of the original staircase comprising an unsupported front end portion overhanging the original riser and a top surface being configured and disposed to contact and support a user standing on the original tread while using the original staircase prior to refacing, the front end portion extending from the original riser to a front edge of the original tread;

the original riser prior to refacing of the original staircase comprising an exposed front surface nearest to the front edge of the original tread and facing towards the front edge of the original tread;

the replacement tread placed on top of the original tread, the replacement riser being adjacent to the front surface of the original riser, the replacement riser and the original tread defining a seam between the replacement riser and the original tread;

the replacement tread comprising an overhanging portion and a scotia, the overhanging portion that overhangs the original tread and the scotia extending downwardly from the overhanging portion;

the scotia comprising a surface covering the front edge of the original tread and extending downwardly past the original tread; and the replacement riser being immediately adjacent to the surface of the scotia whereby the scotia covers the seam between the replacement riser and the original tread.

12. The replacement staircase of claim 11 comprising a bullnose at the front edge of the original tread, the replacement tread covering the bullnose.

13. The replacement staircase of claim 12 wherein the surface of the scotia is immediately adjacent the front edge of the original tread.

14. The replacement staircase of claim 12 wherein the overhanging portion of the replacement tread extends to a front end and the scotia is spaced away from the front end of the replacement tread.

15. The replacement staircase of claim 12 wherein the replacement tread is mechanically attached to the original tread by one or more fasteners extending through the replacement tread and into the original tread.

16. The replacement staircase of claim 15 comprising a second replacement riser extending between the replacement tread and a second original tread, the second replacement riser covering the one or more fasteners.

17. The replacement staircase of claim 11 wherein the overhanging portion of the replacement tread includes a front edge and the scotia is spaced away from the front edge of the replacement tread.

18. The replacement staircase of claim 11 wherein the replacement riser extends between the original tread and a second replacement tread covering a second original tread, the replacement riser covering at least one fastener attaching the second replacement tread to the second original tread.

19. The replacement staircase of claim 11 wherein the original tread and the original riser define a rise/run ratio and the replacement tread and the replacement riser define the same rise/run ratio.

20. The replacement staircase of claim 11 wherein the replacement riser is spaced from the original riser by one or more shims.

* * * * *